United States Patent [19]

Schaevitz

[11] Patent Number: 4,867,273

[45] Date of Patent: Sep. 19, 1989

[54] STAND FOR SUPPORTING THE BODY OF A WORKER

[76] Inventor: Lester P. Schaevitz, 431 N. Latch's La., Merion Station, Pa. 19066

[21] Appl. No.: 292,485

[22] Filed: Dec. 29, 1988

[51] Int. Cl.[4] ..... B25H 5/00

[52] U.S. Cl. ..... 182/116; 182/129; 182/152; 280/32.5

[58] Field of Search ..... 182/116, 230, 129, 152; 280/32.5

[56] References Cited

U.S. PATENT DOCUMENTS

| | | | |
|---|---|---|---|
| 2,701,168 | 2/1955 | Schemeris . | |
| 2,969,123 | 1/1961 | Jamerson et al. . | |
| 2,970,668 | 2/1961 | Snyder . | |
| 3,976,155 | 8/1976 | Esch | 182/116 |
| 4,072,207 | 2/1978 | Bolis . | |
| 4,397,374 | 8/1983 | Rumage et al. . | |
| 4,530,419 | 7/1985 | Rumage et al. . | |
| 4,542,806 | 9/1985 | Olson . | |
| 4,618,029 | 10/1986 | Lowry . | |
| 4,727,958 | 3/1988 | Botello | 182/116 |

OTHER PUBLICATIONS

Brochure entitled "Mech-Aid" by Friesen Enterprises, Incorporated.

*Primary Examiner*—Reinaldo P. Machado
*Attorney, Agent, or Firm*—Paul & Paul

[57] ABSTRACT

A workers support stand that provides support to either the upper or lower portion of a workers body is disclosed. The stand can be collapsed and folded to make it compact for storage purposes, and when in its operational position, provides a sturdy and well-balanced, adjustable support stand that can support a worker leaning backward or forward.

19 Claims, 5 Drawing Sheets

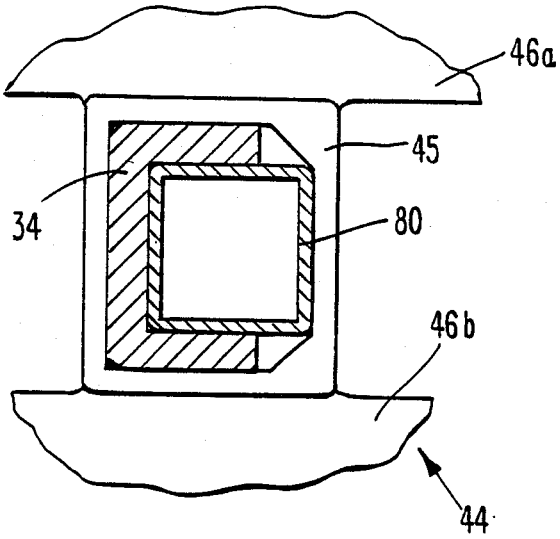
Fig. 4
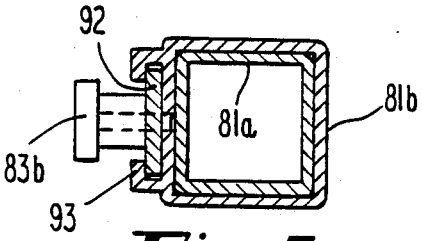
Fig. 5
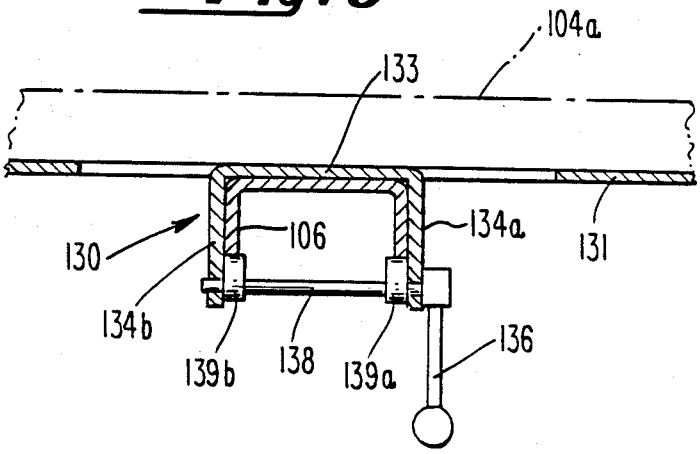
Fig. 7
Fig. 9
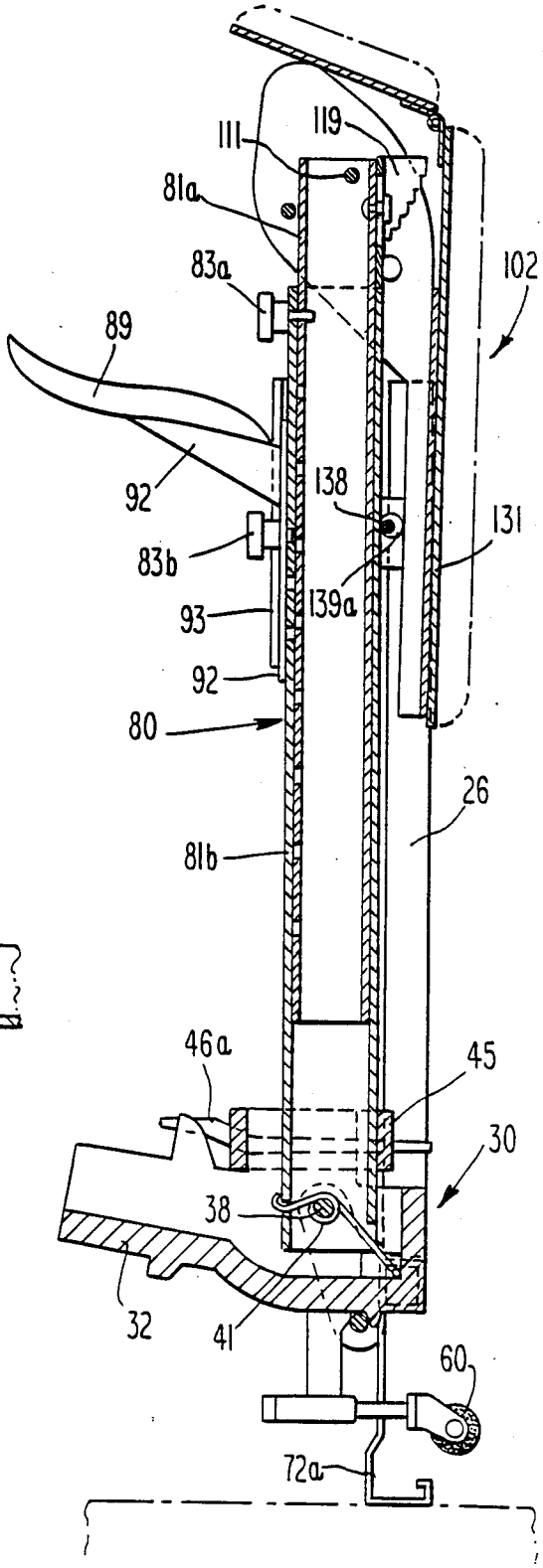

STAND FOR SUPPORTING THE BODY OF A WORKER

BACKGROUND OF THE INVENTION

1. Field of the Invention

The instant invention relates to a method and apparatus for providing support to workers who must use their hands and arms to perform a task while they are standing or sitting in an unbalanced or awkward position. The method and apparatus of the invention can accommodate a worker or user of any size, shape or weight who might be performing jobs that call for, for instance, leaning backward and working overhead while sitting or standing or leaning forward while standing, such as leaning from the waist over an engine compartment In addition, the instant invention provides the worker with a sturdy and reliable but yet efficiently packaged device that is convenient and unobtrusive when in its operational position is mobile enough that it does not impede performance, and can be quickly and easily collapsed and folded, when the task is completed, to be stored out of the way.

2. Description of the Prior Art

In industry and business today, there are many jobs, such as working over large blueprints or sections of delicate material or underneath an airplane wing or automobile, that require the worker to bend at the waist forward or backward for a period of time. This bending can put severe strain on back or stomach muscles or on the legs or arms and there is usually fatigue and sometimes the possibility of a very costly accident. In some cases, it is possible to put some temporary support, such as a cushion, under part of the body, but this then causes a delay in job performance when the support must be taken up and repositioned, and the cushion might damage the work surface. Also in many jobs, varying the height or extending out over the work area is required and temporary cushions cannot be used at al.

There are known devices to assist a mechanic working on an automobile or the like. U.S. Pat. Nos. 4,618,029, 4,542,806, 4,530,419, 4,397,374, 4,072,209, and 2,969,123 all disclose some form of mechanic's support. These devices have frame members that are held together by struts or scaffolding and provide a resting platform for a worker's upper body. Some of these inventions have a plurality of wheels fixed at the corners of a basically rectangular-shaped undersurface and others include a ladder extending upwards from the base. In a few instances, the device may be folded up for storage, but in these cases the worker is limited to the range that he can extend his arms to because of the limited size of support structure. Also, these devices are all limited to jobs where the worker's body position is leaning forward at the waist. In various jobs, there are quite different requirements for supporting different parts of the body, such as leaning backward while working overhead, where these devices are not useful.

SUMMARY OF THE INVENTION

The present invention provides a foldable and collapsible and mobile workers support stand that can support a worker's lower body or upper body while the worker is performing tasks with his arms and hands. The stand has a pair of spaced apart and substantially parallel base legs that join together at a common, centrally-located junction and retainer means fixed thereto to releasably hold a pivotal stem in either a folded or operational position with means fixed thereto to provide mobility. Adjustable footrests and a seat are releasably attached to the stem and an adjustable body support section is pivotally connected to the distil end thereof. The body support section can be easily fixed in a variety of angularly extendible positions, over an angular range of about 80°, and it folds flat adjacent the stem and the legs when not in use to make the support stand very compact for storage.

OBJECTS OF THE INVENTION

It is therefore an object of the present invention to provide a workers support stand that can support either the upper or the lower part of a workers body and allow complete freedom of movement of the worker's arms and hands.

It is a further object of the present invention to provide a workers support stand that can support either the upper or lower part of a workers body in an immovable position while the worker is resting on it but can be easily moved to a different location once the worker takes his weight off of it.

It is still further object of the present invention to provide a workers support stand that can support the upper or lower part of a workers body in an immovable position while the worker is resting on it but can be easily moved to a different location once the worker takes his weight off of it.

These and other advantages and distinctions of the present invention will become apparent upon reading the following detailed description taken in light of the accompanying drawings.

BRIEF DESCRIPTION OF THE DRAWINGS

FIG. 4 shows a horizontal cross-sectional view of the workers support stand 20 taken along lines IV—IV of FIG. 2;

FIG. 5 shows a horizontal cross-sectional view of the stem 80 of the workers support stand 20 taken along lines V—V of FIG. 2;

FIG. 7 shows a vertical cross-sectional view of the rotatable support means 102 of the workers support stand 20 taken along lines VII—VII of FIG.2;

FIG. 9 shows a vertical cross-sectional view of the workers support stand taken along lines VIII—VIII of FIG. 7;

DETAILED DESCRIPTION OF THE PREFERRED EMBODIMENT

Figure 8:
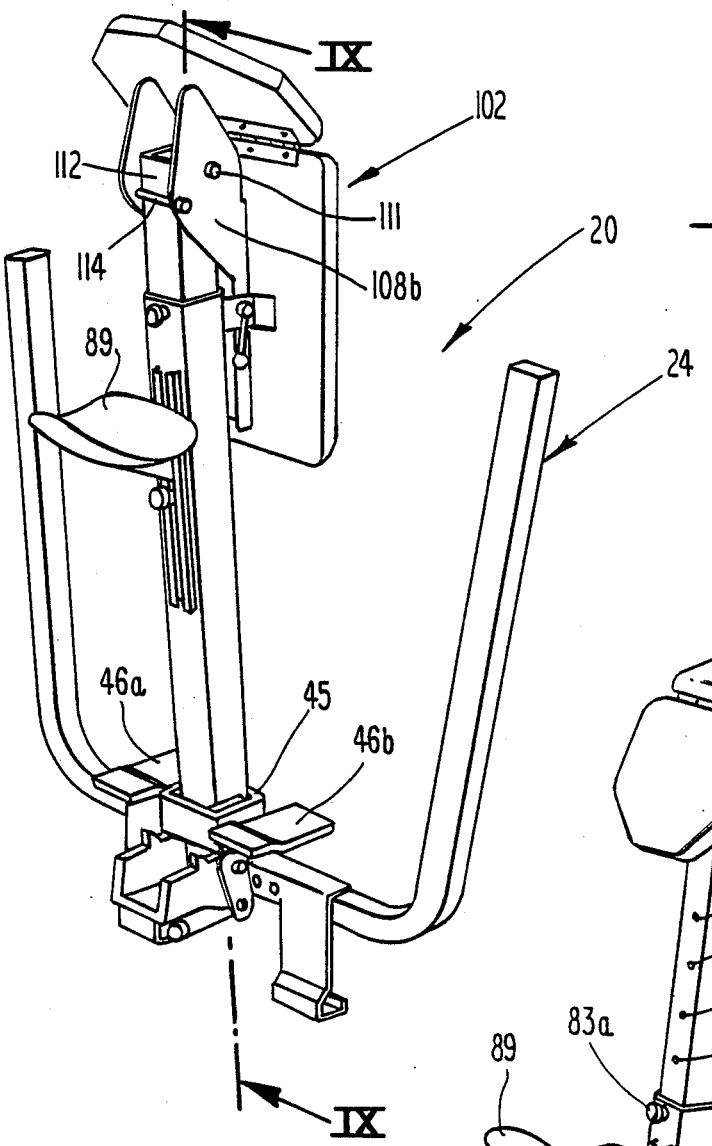
FIG. 8 shows a perspective view of the workers support stand 20 in its collapsed and folded, storage, position.
Figure 1:
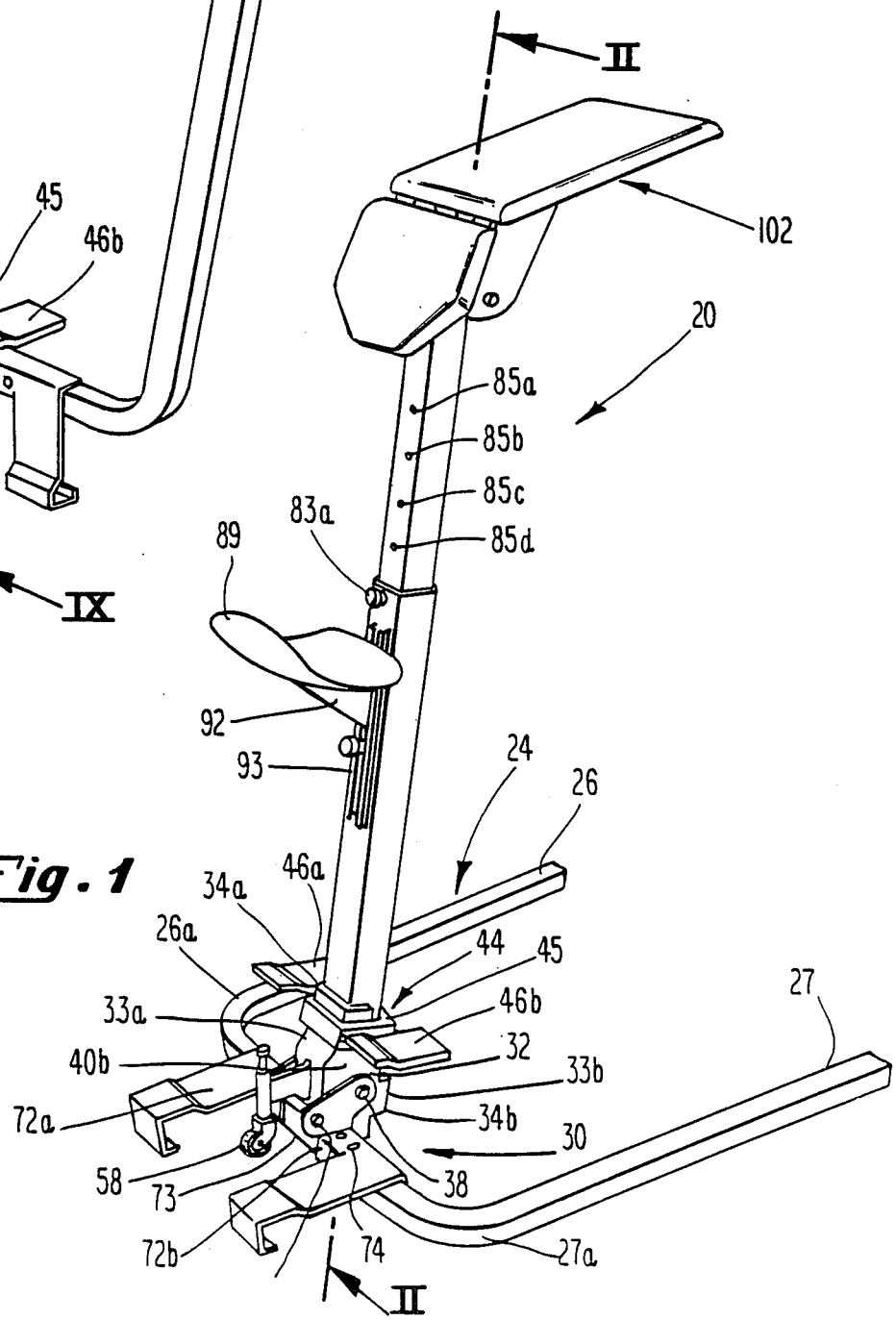
FIG. 1 shows a perspective view of a workers support stand 20 in its unfolded and operational position.
Figures 2, 6:
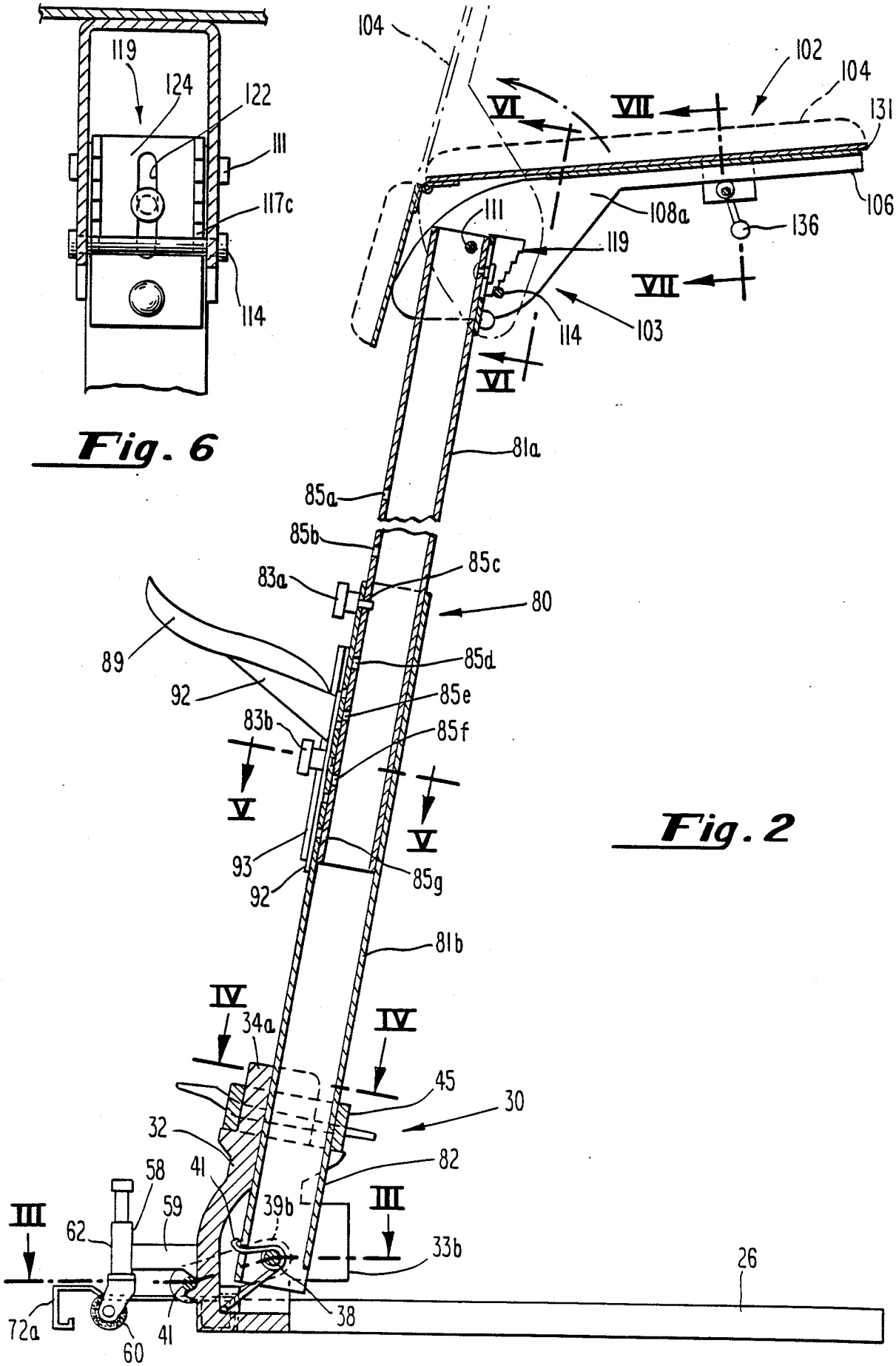
FIG. 2 shows a vertical cross-sectional view of the workers support stand 20 taken along lines II—II of FIG. 1.
FIG. 6 is a fragmentary, vertical cross-sectional view taken along lines VI—VI of FIG. 2.

The present invention involves a workers support stand that can provide steady but adjustable support to a worker's upper or lower body portion as the worker performs jobs from an unbalanced or leaning position. FIG. 1 shows a perspective view of a workers support stand 20 in its extended and unfolded operational position and FIG. 2 shows a vertical cross-sectional view taken along lines II'II of FIG. 1. When support stand 20 is not being used, parts of it are collapsed into other parts and the stand is folded up for storage (as will be explained below) as shown in FIG. 8.

Support stand 20, in its operational position, uses a base 24 to maintain firm and steady contact with the underlying surface, such as the floor or a road. Base 24 is comprised of two legs 26, 27, spaced apart a predetermined distance in a substantially parallel relationship to one another. Legs 26, 27 are each formed into arcuate sections 26*a*, 27*a* of approximately 90° and can be made from tubular aluminum sections or the like.

Sections 26*a*, 27*a* are held together, such that the base 24 forms a U-shape, at a central and common location by bracket means 30. Means 30 is one of the key components of the instant invention and provides the structure that allows for easy storage of stand 20, that adds extra strength to other main components, that adds mobility to the stand when it is in its operational position and that gives some variation to height, or the reach of a worker by adding extra levels of footrests for the worker to stand on. Means 30 comprises a right angle channel bracket 32, a collar and footrest 44, a mobility server 58 and a reinforcement platform 72.

Bracket 32, along with base 24 and a central stem 80, provide a novel form of lower framework that a worker can work on without worry of slippage or sudden collapse. Bracket 32, made from cast aluminum, is a channel formed in a right angle so as to provide twin, bracing sleeves 33*a*, 33*b* for the proximal end 82 of stem 80. As seen in FIGS. 1 and 2, sleeve 33*a* has a three-sided lip 34*a* that, when end 82 is placed in the operational mode, surrounds the back and two opposite sides thereof. In a similar fashion, sleeve 33*b* has a pair of oppositely-placed tabs 34*b* that extend off the top thereof. A collar and footrest 44, comprising a square-shaped doughnut 45 with equal footrest platforms 46*a*, 46*b* welded to opposite sides thereof, is moved up or down stem 80 to allow pivotal movement of stem 80 inside means 30. FIG. 4 shows a horizontal cross-sectional view of collar 44 as taken along lines IV—IV of FIG. 2. When stem 80 is placed substantially perpendicular to base 24, collar 44 is set around lip 34*a* to rest upon shoulders 36*a* to prevent pivotal movement thereof. Likewise, when base 24 is in its storage position, collar 44 is set around tabs 34*b* and onto shoulders 36*b* to restrict any pivotal movement thereof and maintain stem 80 and base 24 in a substantially parallel relationship.

Figure 3:
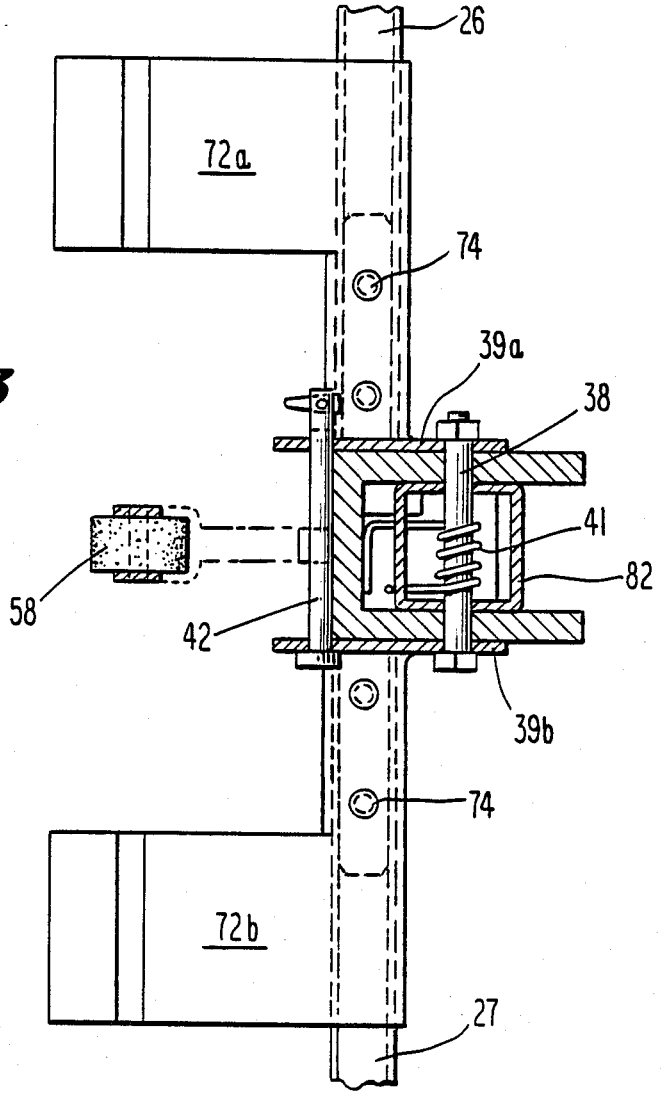
FIG. 3 shows a horizontal cross-sectional view of the workers support stand 20 taken along lines III—III of FIG. 2.

As shown in FIGS. 2 and 3, a permanent pivot pin 38 is inserted through carefully aligned apertures in first and second safety ears 39*a*, 39*b* (only ear 39*b* shown in FIG. 1), opposite lower sides 40*a*, 40*b* (only 40*b* shown in FIG. 1) of bracket 32 and the proximal end 82 of stem 80. Additionally, a spring 41 (see FIG. 3) is wrapped around pin 38, for a purpose to be described, at the central part thereof and hooked underneath the lower edge of end 82, and inside of opposite lower sides 40*a*, 40*b*. A removeable hinge pin 42 is inserted through anterior apertures in ears 39*a*, 39*b* (ear 39*b* shown in phantom in FIG. 2) in a position adjacent and directly under extension 59 from the back face of bracket 32 to mobility server 58.

Ears 39*a*, 39*b* are used to provide suitable connections for pins 38 and 42 and also are elements of the safety features that protect a worker as stand 20 is being used. As can be seen in FIG. 1, ears 39*a*, 39*b* form perpendicular extensions to, respectively, reinforcement platforms 72*a*, 72*b*. Platforms 72*a*, 72*b* are extensions of a solid bar 73 affixed to the lower back side of casting 32 to extend partially, for a predetermined distance, inside the ends of arcuate sections 26*a*, 27*a*. A suitable fastener, such as a bolt 74, is used to secure platforms 72*a*, 72*b* to sections 26*a*, 26*b* and bar 73, and this combination adds more redundancy of safety features to the stand.

Mobility server 58 is attached to the lower back side of bracket 32 by extension 59. Server 58 is comprised of a spring-loaded castor 60 set inside tube 62. Tube 62 is fixed to extension 59 and the spring-force (spring not shown) is sufficient to support the weight of the back end of stand 20 without a worker on it.

Two sections 81*a*, 81*b* of stem 80 are made to collapse the upper section 81*a* inside the lower section 81*b*, as shown in FIG. 2. A spring-loaded cartridge pin 83 as used in the industry, is used to separate the two sections a preferred distance by being removably inserted into a pair of aligned openings 85*a, b, c, d, e, f* and *g*.

In one embodiment, a seat 89 is fixed, as by welding, for example, to a flange 92 and flange 92 is affixed to bracket 93. A pin 95, similar to pin 83, is then used to secure bracket 93 to the stem 80 at any one of unused openings 85 *a–g*.

FIG. 5 shows a horizontal cross-sectional view of the stem 80 taken along lines V—V of FIG. 2. FIG. 5 shows how a spring-loaded connector pin 83*b* (spring not shown) is used to adjustably position seat-support flange 92 along stem 80. Pin 83 can be ne of apertures 85 *a–g* and seat 89 and flange 92 adjusted as required for the job. Pin 83 is then released to pierce through the aligned apertures in stem parts 81*a*, 81*b*. In a similar fashion, pin 83*a* is used to adjust the amount of extension between stem parts 81*a*, 81*b* (see FIG. 2).

At the distal end of stem 80, as seen in FIG. 2, is a rotatable body support means 102. Support means 102 is another key component of stand 20 and utilizes a novel, camming ratchet means 103 to allow a worker to adjust the torso pad -hip pad combination 104 (pads 104 seen in phantom in FIG. 2) to a comfortable angular elevation according to the job being done. For example, a worker could stand on footrests 44 with his or her back against pad 104 when it was angled straight up and down. FIG. 6 shows a fragmentary, vertical cross-sectional view of means 103 as seen along lines VI—VI of FIG. 2.

Support means 102 is comprised of extension means made of a channel 106 having dual oblong-shaped wings 108*a*, 108*b* pivotly fixed by pin 111 to the distil end 112 of stem 80. Pin 11 extends through an aperture at a predetermined location in end 112 and through a first set of apertures at predetermined locations in wings 108*a*, 108*b*. A camming bar 114 also extends through a second set of apertures at second predetermined locations in wings 108*a*, 108*b* and rides against one of a plurality of attached, as by bolt 121 through slot 122 in central section 124, to end 112. Bracket 119 has stairwell-like side sections 124*a* 124*b* that have pre-calculated edges 117*a–e* thereon. As a lifting force picks up the end of channel 106, wings 108*a*, 108*b* pivot around pin 111 (as shown in phantom in FIG. 2) and bar 114 slides along edges 117*a–e*. When means 102 is at the proper angular elevation, and the lifting force is discontinued, the weight of means 102 causes bar 114 to jam against a camming edge.

FIG. 7 shows a vertical cross-sectional view of support means 102 of stand 20 taken along lines VII—VII of FIG. 2. Pad combination 104 (shown in phantom) is attached to a torso pad table 131, that in turn, is attached to the outside of the central section 133 of an extension channel 130. Channel 130 is made with precalculated interior dimensions of width of section 133 and depth of sides 134*a*, 134*b* to slidingly fit around those surfaces on channel 106. A handle 136 on a rotatable pin 138 through sides 134*a*, 134*b* with eccentrics 139*a*, 139*b* thereon is used to stop sliding movement of pads 104. Whenever torso pad 104*a* is in the proper position, handle 136 is turned, thereby twisting eccentrics 139*a*, 139*b* to jam up against the edges of channel 106 and, as torso pad 104*a* moves forward or backward, hip pad 104*b* is drawn along the outer precalculated contours of wings 108*a*, 108*b* to a comfortable position for the worker.

Operation of the Workers Stand

FIG. 8 shows a perspective view of stand 20 in its storage-ready position. FIG. 9 shows a vertical cross-sectional view of stand 20 taken along lines IX—IX of FIG. 8. When a worker wishes to store stand 20, handle 136 is twisted to release eccentrics 139 and table 131 is moved to align the end of pads 104 with the end of channel 106. Handle 136 is re-twisted to tighten up eccentrics 139 and maintain the two pieces together. Now bar 114 is removed and support means 102 allowed to pivot around pin 111 to a position substantially parallel with stem 80. Bar 114 can then be re-inserted in its apertures, which have now rotated to a position on the opposite side of stem 80, to fix support means 102 in this folded position.

The next step to folding stand 20 involves folding base 24 to a substantially parallel position to support means 102 and stem 80. Collar 44 is pushed up along stem 80 to just clear lip 34*a* and pin 42 is removed from the apertures in pieces 39*a*, *b*. Once base 24 is lifted to the desired position, collar 44 is lowered to settle around tabs 34*b*, thereby securing stem 80 and base 24. Stand 20 can now be leaned against a wall or other vertical storage post and rests upon heel plates 75*a*, *b*, which extend at a right angle from platforms 72*a*, *b*, respectively.

Figure 11:
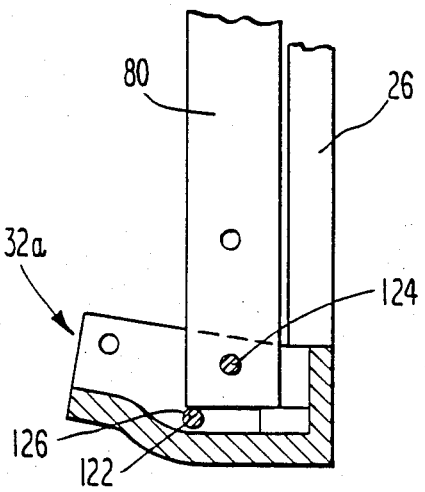
FIG. 11 shows a fragmentary schematic view of the alternate embodiment of main casting 32 and stem 80, similar to FIG. 7, showing pin connections as the stand 20 is folded for storage.
Figure 10:
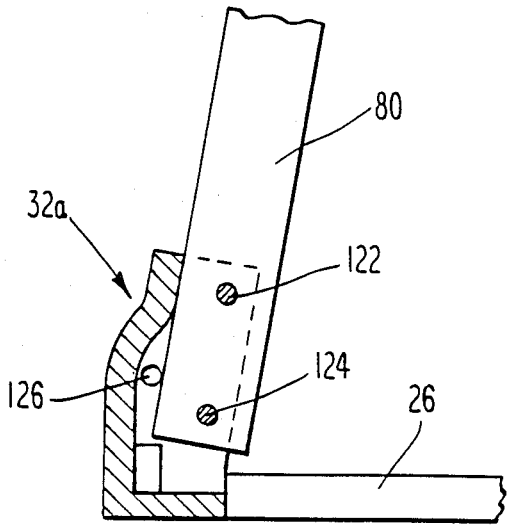
FIG. 10 shows a fragmentary schematic view of an alternate embodiment of main casting 32 and stem 80, similar to FIG. 1, showing pin connections as the support stand 20 is in its operational position.

FIG. 10 shows a fragmentary, schematic cross-sectional view of an alternate embodiment of bracket 32*a*, as the stand 20 is in its operational position, and FIG. 11 shows a fragmentary, schematic cross-sectional view of the alternate embodiment of bracket 32*a* as it is in the folded position. In this alternate form, two pins 122 and 124 are inserted through aligned apertures in the casing 32*a* and the end of stem 80. When it is desired to fold base 24 towards stem 80, first pin 122 is removed, to allow base 24 to pivot about pin 124. Pin 122 is then reinserted at aperture 126 to lock the pieces together.

Figure 12:
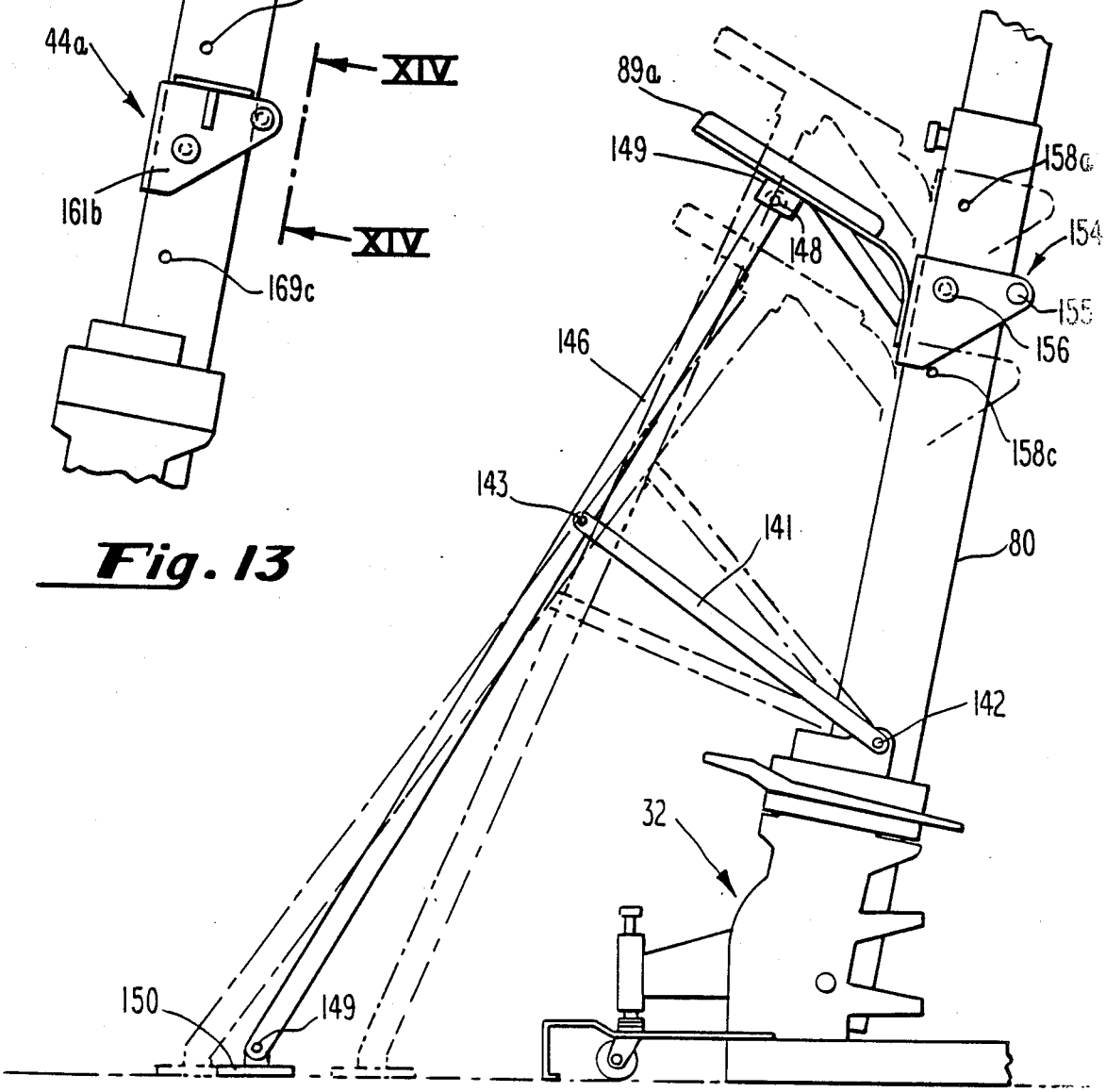
FIG. 12 shows a fragmentary side elevational view of an alternate embodiment of seat 89.

FIG. 12 shows a fragmentary side elevational view of an alternate embodiment of seat 89*a* with several different positions thereof shown in phantom. As seen in FIG. 12, lip 34 has a strut 141 pivotably attached at pin 142 at one end and pivotably, at a predetermined point, at pin 143, on support strut 146. Strut 146 is pivotably attached underneath seat 89*a*, as at pin 148 through tabs 149, and at its opposite end has a pivotable attachment, such as a pin 149, to a shoe 150. Seat 89*a* is supported by bar 152, which bar is curved into an approximate right angle, as shown, and is fastened to a small channel section 154. Section 154 conforms to the shape of stem 80, has a pin 155 holding opposite sides together, and employs a spring-loaded plunger 156, similar to pin 83*a*, to send an end through apertures in section sidewall 157 and into one of a plurality of apertures 158*a–c*. FIG. 12 shows different positions of seat 89*a* and supporting structure in phantom.

Figure 14:
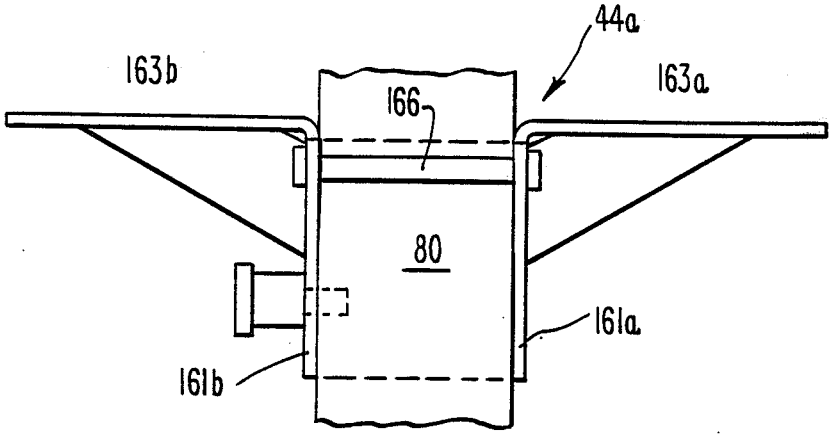
FIG. 14 shows a vertical cross-sectional view of alternate footrests taken along lines XIII—XIII of FIG. 12.
Figure 13:
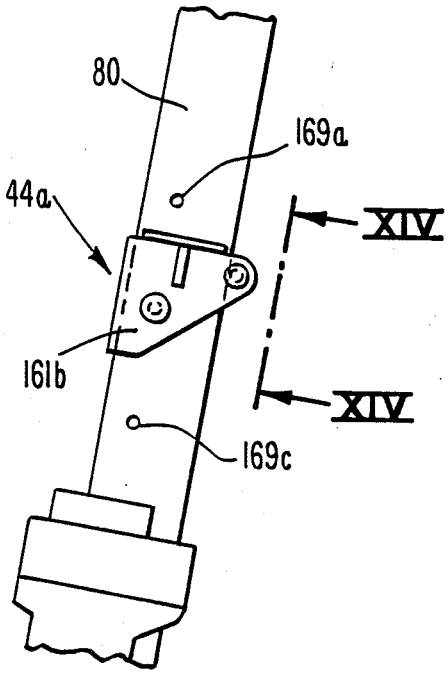
FIG. 13 shows a fragmentary side elevational view of an alternate embodiment, of footrests 72.

FIG. 13 shows an alternate embodiment of footrests 44*a*, without being attached to the locking collar. FIG. 14 is a vertical cross-sectional view of footrests 44*a* taken along lines XIV—XIV of FIG. 13. Footrests 44*a*, which can conveniently be made from a single, aluminum casting, as shown, employ an attachment means similar to that shown for seat 89*a*. Footrest 44*a* is also a channel-shaped structure with opposite sides 161*a*, *b* carrying footrests 163*a*, *b*, as supported by flanges 164*a*, *b*, respectively. A pin 166 is attached through sides 161 *a*, *b* and a plunger 168 is used to fix side 161*b* at any one of a plurality of apertures 169*a*, *b*, or court (169*b* is not shown).

It is understood that the above described embodiment is only one of those possible within the scope of the present invention. For instance, a tool pouch or a spot light may be conveniently attached to the end of table 131 to be useful for the worker. These and other changes may all be made within the spirit of the disclosure and the scope of the appended claims.

What I claim is:

1. A foldable and collapsible workers support stand to be set up upon a surface that provides, for a worker performing various tasks with his hands, support for the worker's lower body or the worker's upper body comprising:

a pair of spaced-apart and horizontally disposed legs, substantially parallel to one another, for being placed upon the surface, with each said leg having an arcuate shoulder section and said sections joining at a common, central location;

bracket means affixed to said shoulders adjacent said central location for reinforcing said shoulders and for providing a receptacle;

collapsible stem means having distal and proximal ends, with the proximal end pivotably held by said bracket means, to rotate from an unfolded position substantially perpendicular to said legs to a folded position substantially parallel to said legs;

rotatable and extendible support means attached to said stem means to provide support to the hips and upper torso of the worker.

2. A workers support stand as described in claim 1 wherein said bracket means comprises a first, U-shaped channel bracket formed in a right angle with means therein to pivotally attach said stem means thereto and securing means for fixing said stem means in a folded position or an unfolded position.

3. A workers support stand as described in claim 2 wherein said securing means comprises at least one folded and at least one unfolded projection each extending from said channel and a collar that surrounds said stem means for sliding over either said folded projection or said unfolded projection 4. A workers support stand as described in either claims 2 or 3 wherein said bracket means includes support and balance means.

5. A workers support stand as described in claim 4 wherein said support and balance means is at least one tab extending from the shoulder in a direction opposite to said legs, to contact the surface.

6. A workers support stand as described in claim 4 wherein mobility means is attached to said bracket means to provide a movable contact adjacent said central location to facilitate movement of the stand across the surface.

7. A workers support stand as described in claim 3 wherein said stem means has a retainer stud projecting therefrom and said collar has a retainer aperture therein for removably engaging said retainer stud.

8. A workers support stand as described in claim 4 wherein said stem means comprises a first tubular-shaped member and a second tubular-shaped member to slidingly fit inside said first member and means on both said members to adjustably fix the relative positions thereof.

9. A workers support stand as described in claim 8 wherein said means to adjustably fix comprises a series of spaced-apart apertures in said second member and a spring-biased plunger attached to said first member to removeably engage an aperture.

10. A workers support stand as described in claim 4 wherein said stem means has seat means removably attached thereto to support a worker seated thereon.

11. A workers support stand as described in claim 1 wherein said body support means comprises extension means, rotatable from a folded and locked position to an extended and adjustable position and locking means connected to the distal end of said stem means for securing said extension means in a plurality of positions.

12. A workers support stand as described in claim 11 wherein said extension means comprises a second, U-shaped channel with predetermined inner dimensions of height and width and of predetermined length and being pivotably joined to said stem means, and a third, U-shaped channel with predetermined larger outer dimensions of height and width than said second channel slidingly adjacent the outside of said second channel and at least one body supporting pad fixed to said third channel and means for fixing said channels in a plurality of relative fixed positions along the extension of said second channel away from or toward said stem means.

13. A workers support stand as described in claim 12 wherein said fixing means comprises a bar rotatably extending through the sides of said third channel with a handle affixed thereto for rotating said bar, and having at least one cam surface located adjacent said bar in the vicinity of said second channel rotatable from a first, unengaging position to a second, engaging and camming position to halt sliding movement thereof 14. A workers support stand as described in claim 11 wherein said camming means comprises a bracket-shaped member, having a central section with an elongated aperture therein for slidable attachment with said stem means and having at least one camming edge thereon, a pivot bar through said stem means and said extension means and a camming bar affixed to opposite sides of said bracket to be releasable held on a cam edge to support said extension means in any one of a plurality of extended or folded positions.

15. A workers support stand as described in claim 13 wherein said extension means further includes a pair of substantially parallel, oblong-shaped side members extending from the sides of said second channel.

16. A workers support stand as described in claim 15 wherein said third channel carries a hip-supporting pad hingedly attached to an edge of said body support pad.

17. A workers support stand as described in claim 6 wherein said mobility means is a spring castor mounted inside a castor housing attached to the outer surface of said bracket.

18. A workers support stand as described in claim 10 wherein said seat means comprises a U-shaped bracket, securable in one of a plurality of positions along said stem, a cantilever support fixed to said bracket in the direction opposite to said legs, a support rod pivotally attached beneath said cantilever support and adjustably contacting the surface, a bracing bar pivotally attached between said bracket means and said support bar and a seating surface attached to the upper side of said cantilever support.

19. A workers support stand for supporting the upper or lower portions of a worker, comprising:

a pair of spaced apart and horizontally disposed legs, being substantially parallel to one another and each said leg having a shoulder section, said shoulder sections joining at a common central location;

a, first, U-shaped channel bracket formed at a right angle to form dual sockets with projections extending from said sockets and having the proximal end of a stem member pivotably attached thereto;

a collar around said stem for slipping around said projections;

a bracket-shaped member slidingly attached to the distal end of the stem;

a second, channel section pivotally attached, through a first pin, to the distal end of the stem and having a second pin in a camming relationship with said bracket-shaped member; and a third, channel section slidingly adjacent said second channel section, and having torso pads thereon.

* * * * *

UNITED STATES PATENT OFFICE

CERTIFICATE OF CORRECTION

Patent No. 4,867,273 Dated Sept. 19, 1989

Inventor(s) Lester P. Schaevitz

It is certified that error appears in the above-identified patent and that said Letters Patent is hereby corrected as shown below:

Col. 3, line 18, "taken along lines II'II" should be "taken along lines II-II".
Col. 4, line 46, 47, after "Pin 83 can be" insert "retracted from any one".
Col. 4, line 67, "Pin 11" should be "Pin 111".
Col. 5, line 5, after "plurality of" and before "attached" insert "camming edges 117 a-e in bracket 119. Bracket 119 is slidably"
Col. 4, line 47, delete "ne".

Signed and Sealed this

Sixteenth Day of October, 1990

*Attest:*

HARRY F. MANBECK, JR.

*Attesting Officer*

*Commissioner of Patents and Trademarks*